US009303534B2

(12) United States Patent
Fabros

(10) Patent No.: US 9,303,534 B2
(45) Date of Patent: Apr. 5, 2016

(54) CYLINDER VALVE SYSTEM AND METHOD FOR ALTERING VALVE PROFILE

(71) Applicant: Ford Global Technologies, LLC, Dearborn, MI (US)

(72) Inventor: Charles Fabros, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 197 days.

(21) Appl. No.: 13/774,982

(22) Filed: Feb. 22, 2013

(65) Prior Publication Data

US 2014/0238322 A1 Aug. 28, 2014

(51) Int. Cl.
*F01L 1/24* (2006.01)
*F01L 1/18* (2006.01)
*F01L 13/00* (2006.01)

(52) U.S. Cl.
CPC ..... *F01L 1/2416* (2013.01); *F01L 1/185* (2013.01); *F01L 13/0005* (2013.01); *F01L 13/0015* (2013.01)

(58) Field of Classification Search
CPC ... F01L 2001/2444; F01L 9/02; F01L 1/2411; F01L 1/2416; F01L 1/24; F01L 1/2405; F01L 1/2422; F01L 1/255
USPC ..... 123/90.43, 90.45, 90.46, 90.55, 90.12, 123/320, 321
See application file for complete search history.

(56) References Cited

U.S. PATENT DOCUMENTS

| | | | | |
|---|---|---|---|---|
| 5,127,375 | A | 7/1992 | Bowman et al. | |
| 6,425,357 | B2 | 7/2002 | Shimizu et al. | |
| 7,066,159 | B2 * | 6/2006 | Ruggiero et al. | 123/568.14 |
| 7,287,497 | B2 * | 10/2007 | Sun et al. | 123/90.12 |
| 7,509,933 | B2 | 3/2009 | Dingle | |
| 8,307,793 | B2 * | 11/2012 | Paolo et al. | 123/90.12 |
| 8,596,234 | B2 * | 12/2013 | Choi et al. | 123/90.12 |
| 8,607,751 | B2 * | 12/2013 | Yang et al. | 123/90.16 |
| 8,646,422 | B2 * | 2/2014 | Choi et al. | 123/90.11 |
| 8,733,303 | B2 * | 5/2014 | Lanfranco et al. | 123/90.12 |
| 8,813,696 | B2 * | 8/2014 | Choi | 123/90.12 |
| 2006/0054118 | A1 * | 3/2006 | Pecori et al. | 123/90.12 |
| 2006/0236958 | A1 * | 10/2006 | Sun et al. | 123/90.12 |
| 2007/0113808 | A1 | 5/2007 | Lyngfelt et al. | |
| 2009/0000580 | A1 * | 1/2009 | Proschko | 123/90.11 |
| 2009/0308340 | A1 * | 12/2009 | Gecim et al. | 123/90.57 |
| 2011/0220055 | A1 * | 9/2011 | Gallon et al. | F01L 13/0015 123/193.5 |
| 2011/0265746 | A1 | 11/2011 | Fabros | |
| 2012/0042840 | A1 * | 2/2012 | Choi et al. | 123/90.16 |
| 2012/0292541 | A1 * | 11/2012 | Rinnert et al. | 251/30.01 |
| 2013/0047942 | A1 * | 2/2013 | Allmond | 123/90.12 |

FOREIGN PATENT DOCUMENTS

EP 1174594 A1 1/2002

* cited by examiner

*Primary Examiner* — Thomas Denion
*Assistant Examiner* — Daniel Bernstein
(74) *Attorney, Agent, or Firm* — Greg Brown; Alleman Hall McCoy Russell & Tuttle LLP

(57) ABSTRACT

A cylinder valve system in an engine is provided. The cylinder valve system includes a first oil pressurized bore corresponding to a cylinder valve and in fluidic communication with a control valve assembly, the control valve assembly comprising at least one hydraulic valve and a second oil pressurized bore corresponding to the cylinder valve and in fluidic communication with the control valve assembly.

20 Claims, 4 Drawing Sheets

CYLINDER VALVE SYSTEM AND METHOD FOR ALTERING VALVE PROFILE

FIELD

The present invention relates a valve system and method for adjusting a cylinder valve lift profile.

BACKGROUND AND SUMMARY

Variable valve lift may be used in engines to increase efficiency and decrease emissions over a wide range of engine operating conditions. For instance, a cylinder valve lift magnitude and/or opening/closing duration may be altered via a valve adjustment system based on various engine operating conditions, such as engine temperature, fuel injection magnitude/timing, engine load, engine speed, requested torque, etc. It may also be desirable to deactivate selected cylinders via a valve adjustment system during certain engine operating conditions to increase engine efficiency, decreases emissions, and/or decrease fuel usage. For instance, cylinder valves corresponding to a cylinder may be deactivated during engine idle or low engine speeds.

However, valve systems with variable valve lift functionality may include complicated hydraulic sub-systems as well as other control sub-systems which may use a large amount of energy in the engine, thereby subverting some of the efficiencies achieved through valve lift adjustment. Thus, the energy used by the valve system may offset some of the efficiencies achieved via the variation in valve lift.

As such in one approach, a cylinder valve system in an engine is provided. The cylinder valve system includes a first oil pressurized bore corresponding to a cylinder valve and in fluidic communication with a control valve assembly, the control valve assembly comprising at least one hydraulic valve. The cylinder valve system further includes a second oil pressurized bore corresponding to the cylinder valve and in fluidic communication with the control valve assembly. Adjustment of the oil pressure in the first and second bores enables cylinder valve profile adjustment. In this way, multiple hydraulic bores may be incorporated into a valve system to enable valve lift magnitude and/or opening/closing duration adjustment as well as cylinder valve deactivation, if desired.

In one example, a lash adjuster may be positioned in the second oil pressurized bore and a valve stem and valve spring may be positioned in the first oil pressurized bore, the valve stem mechanically coupled to the lash adjuster. In this way, hydraulic force on both the valve stem and the lash adjuster may be independently adjusted via the control valve assembly to enable valve lift profile control.

Further in one example, the oil pressure in the first and/or second pressurized bores may be altered to inhibit valve stem movement in the valve assembly, to deactivate the cylinder valve. Specifically, in one example, oil from an active cylinder may be transferred to the first oil pressurized bore to inhibit activation. In this way, hydraulic motion from an active cylinder valve may be used to deactivate another cylinder valve. As a result, the efficiency of the valve system is increased while decreasing engine fuel usage through cylinder deactivation.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The present description relates to a cylinder valve system for adjusting a valve lift profile (e.g., valve lift magnitude and a valve opening/closing duration). The cylinder valve system includes a first oil pressurized bore and a second oil pressurized bore. The first bore encloses a valve stem and valve spring and the second bore encloses a lash adjuster. The oil pressure in the bores may be adjusted via a control valve assembly to enable valve profile adjustment. Specifically, the oil pressure in the first bore and/or the second bore may be adjusted to alter valve opening and closing durations as well as the valve lift magnitude. Adjustment of the oil pressure in the first bore and/or the second bore may also facilitate cylinder valve deactivation where the valve is substantially inhibited from opening and closing, thereby reducing pumping losses in the engine during certain engine operating conditions. During valve deactivation hydraulic motion from an active cylinder valve may be transferred to the first oil pressurized bore to inhibit valve stem movement, thereby increasing the cylinder valve system efficiency A low (e.g., minimum) lift of the cylinder valve system may be defined by a cam profile, a cam follower, and the lash adjuster. Therefore, the low (e.g., minimum) valve lift and opening/closing duration may be provided without wasted motion, only augmentation of lift and/or duration may need additional energy input into the cylinder valve system and augment existing motion and reduces the amount of wasted motion (e.g., generate no wasted motion).

Figure 1:
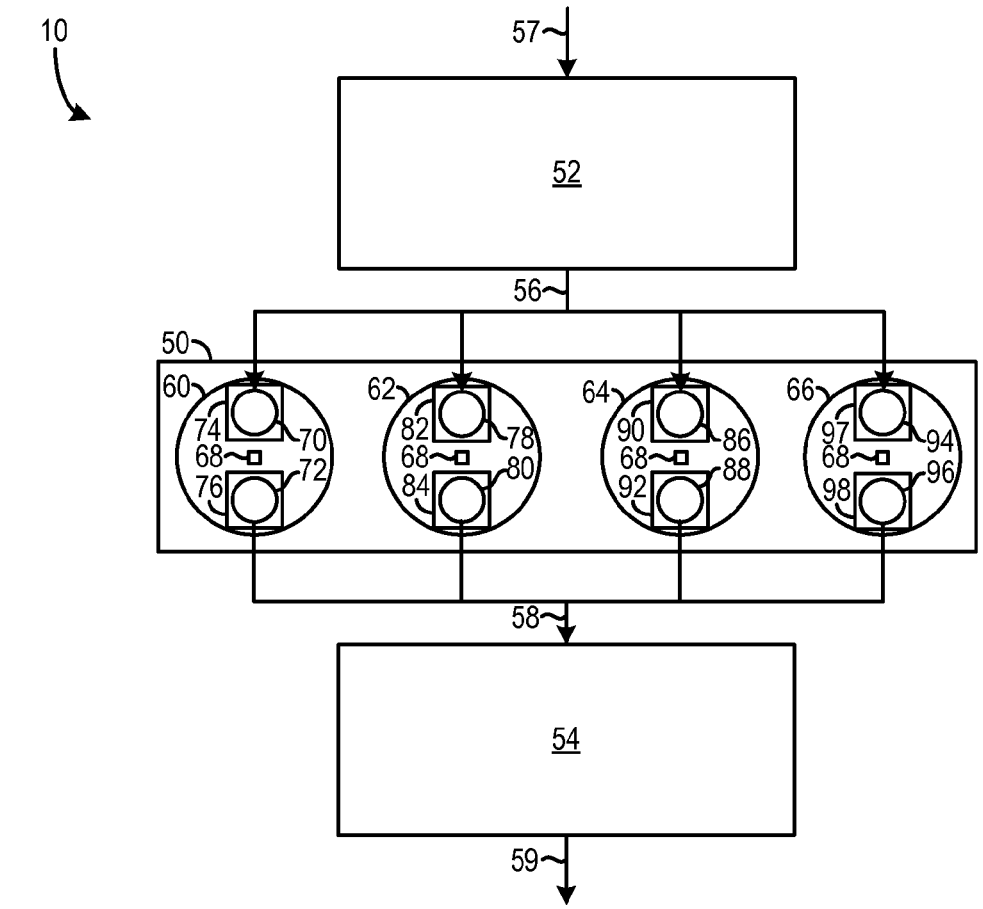
FIG. 1 schematically shows a vehicle including an engine.
Figure 1:
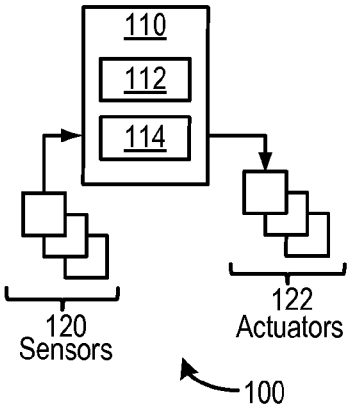

FIG. 1 shows a schematic depiction of a vehicle 10 including an engine 50, an intake system 52 and an exhaust system 54. The intake system 52 is configured to provide intake air to the engine 50 denoted via arrows 56. The intake system also receives intake air from the surrounding atmosphere denoted via arrow 57. The exhaust system 54 is configured to receive exhaust gas from the engine 50 denoted via arrows 58. Arrow 59 denotes the flow of exhaust gas from the exhaust system 54 to the surrounding atmosphere. The intake system 52 may include one or more of the following components, an air filter, a throttle, an intake manifold, intake conduits, etc. The exhaust system 54 may include one or more of the following components an exhaust manifold, an emission control device (e.g., particulate filter, catalyst, etc.), a muffler, etc.

The engine 50 includes four cylinders (60, 62, 64, and 66). The cylinder 60 may be referred to a first cylinder, the cylinder 62 may be referred to as a second cylinder, the cylinder 64 may be referred to as a third cylinder, and the cylinder 66 may be referred to as a fourth cylinder. The cylinders may be arranged in an inline configuration in which a plane extends through a centerline of each cylinder. However, other cylinder arrangements have been contemplated. For instance, the cylinders may be arranged in a V-configuration in which banks of cylinders comprising one or more cylinders are arranged at non-straight angles with regard to one another. Other engine configurations such as horizontally opposed configurations have also been contemplated.

An ignition device 68 (e.g., spark plug) may be coupled to each cylinder. The ignition devices may be configured to provide an electric spark to initiate combustion of an air/fuel mixture in the cylinders. Additionally or alternatively, compression ignition may be used in the cylinders. The firing order of the cylinders may be 1-3-4-2. Thus, combustion may be performed in the cylinder 60, the cylinder 64, the cylinder 66, and then the cylinder 62. It will be appreciated that in some examples portions of the combustion operation in the cylinders may be performed at over-lapping time intervals, if desired. Furthermore, it will be appreciated that alternate firing order strategies have been contemplated.

The cylinder 60 may include an intake valve 70 and an exhaust valve 72 coupled thereto. The intake valve 70 may be included in a cylinder valve system 74 and the exhaust valve 72 may be included in a cylinder valve system 76. Additionally, the cylinder 62 includes an intake valve 78 and an exhaust valve 80. The intake valve 78 may be included in a cylinder valve system 82 and the exhaust valve 80 may be included in a cylinder valve system 84. The cylinder 64 includes an intake valve 86 and an exhaust valve 88. The intake valve 86 may be included in a cylinder valve system 90 and the exhaust valve 88 may be included in a cylinder valve system 92. Additionally, the cylinder 66 includes an intake valve 94 and an exhaust valve 96. The intake valve 94 may be included in a cylinder valve system 97 and the exhaust valve 96 may be included in a cylinder valve system 98. The cylinder valve systems are discussed in greater detail herein with regard to FIGS. 2-5.

The aforementioned intake valves and exhaust valves enable selective fluidic communication between the intake system 52 and the exhaust system 54, respectively. Thus, the intake and exhaust valves may be opened and closed to inhibit and enable gas flow between the cylinders and the intake and exhaust systems The vehicle 10 further includes a control sub-system 100. The control sub-system 100 may include a controller 110. The controller 110 is shown in FIG. 1 as a microcomputer, including microprocessor unit 112, input/output ports, a computer readable storage medium 114 for executable programs and calibration values (e.g., read only memory chip, random access memory, keep alive memory, etc.) and a data bus. Storage medium read-only memory 114 can be programmed with computer readable data representing instructions executable by the processor 112 for performing the methods described below as well as other variants that are anticipated but not specifically listed.

The controller 110 may receive information from a plurality of sensors 120 in the engine 50 and/or vehicle 10 that correspond to measurements such as inducted mass air flow, engine coolant temperature, ambient temperature, engine speed, throttle position, manifold absolute pressure signal, intake volume pressure signal, an intake passage pressure signal, air/fuel ratio, fuel fraction of intake air, intake volume pressure, fuel tank pressure, fuel canister pressure, etc. Note that various combinations of sensors may be used to produce these and other measurements. The sensors 120 may pressure sensors positioned in the intake system, an engine temperature sensor, an engine speed sensor, a throttle position sensor, etc.

Furthermore, the controller 110 may control a plurality of actuators 122 of the vehicle 10 and/or engine 50 based on the signals from the plurality of sensors 120. Examples of actuators 122 may a throttle, a fuel injector, a control valve assembly, control valves in the control valve assembly, etc.

Figure 2:
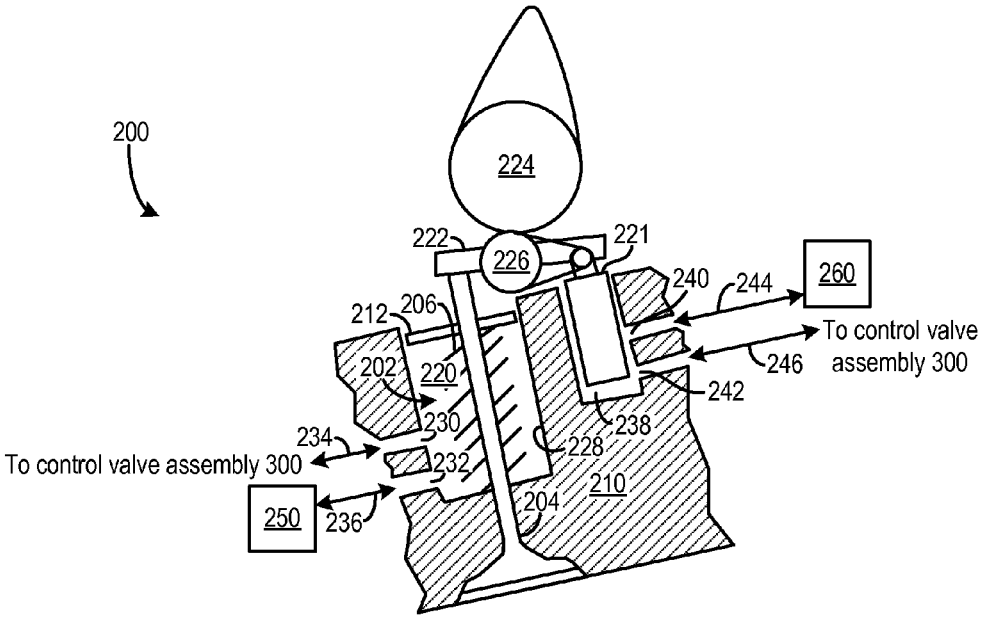
FIG. 2 shows an illustration of an example cylinder valve system which may be included in the engine shown in FIG. 1.
Figure 3:
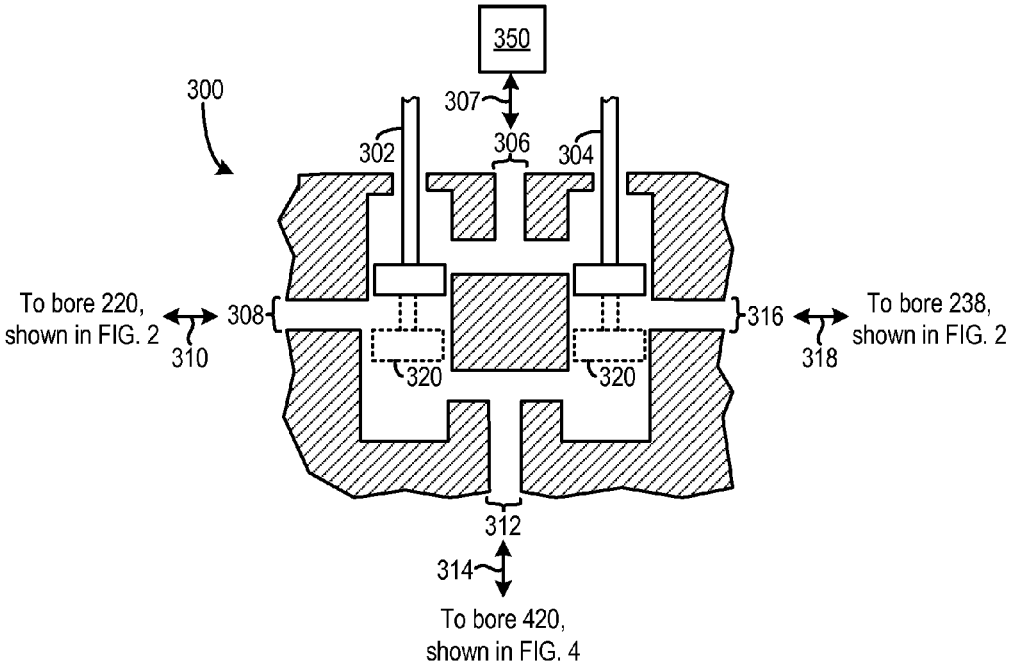
FIG. 3 shows an illustration of an example control valve assembly corresponding to the cylinder valve system shown in FIG. 2.

FIG. 2 shows an illustration of an example cylinder valve system 200 and FIG. 3 shows a control valve assembly 300 corresponding to the cylinder valve system 200 shown in FIG. 2. Thus, the control valve assembly 300 shown in FIG. 3 may be included in the cylinder valve system 200 shown in FIG. 2.

The cylinder valve system 200 shown in FIG. 2 is associated with the cylinder 60, shown in FIG. 1. It will be appreciated that the cylinder valve system 200 may include the intake valve 70 or the exhaust valve 72, shown in FIG. 1. The cylinder valve system 200 includes a cylinder valve 202. The cylinder valve 202 may be an intake valve or an exhaust valve.

The cylinder valve 202 includes a valve stem 204 and a valve spring 206. One end of the valve spring 206 may be in contact with the cylinder head 210. Another end of the valve spring 206 may be in contact with a retainer seal 212. The cylinder valve 202 may seat and seal on a port (e.g., intake port or exhaust port) the cylinder head 210. Thus, the cylinder valve 202 may be an intake valve or an exhaust valve.

The retainer seal 212 provides a seal for a first oil pressurized bore 220. The valve stem 204 may extend through the retainer seal 212. The retainer seal 212 may also be in sealing contact with a wall of the cylinder head 210. The retainer seal 212 may include a flexible material such as rubber and/or plastic. The flexible material may be similar to the material used in the Oil Control Valve for a variable cam timing system.

The cylinder valve system 200 further includes a rocker arm 222. The rocker arm 222 enables augmentation of valve lift and/or opening/closing duration by varying the pivot point at the lash adjuster 221 in convert with and as a result of the camshaft profile. The rocker arm 222 is mechanically coupled to the valve stem 204 and is configured to initiate actuation of the cylinder valve 202.

The cylinder valve system 200 further includes a cam 224. The cam 224 is rotationally coupled to a crankshaft included in the engine 50, shown in FIG. 1. The cam 224 is configured to cyclically actuate the cylinder valve 202. The position of the cam 224 shown in FIG. 2 corresponds to a top dead center (TDC) position of a piston in the cylinder 60, shown in FIG. 1. Continuing with FIG. 2, a cam follower 226 is also included in the cylinder valve system 200. A lash adjuster 221 is also coupled to the rocker arm 222 and the cam follower 226.

The cylinder valve system 200 further includes a first oil pressurized bore 220. The first oil pressurized bore 220 encloses at least a portion of the valve stem 204 and the entire valve spring 206. However, in other examples only a portion of the valve spring 206 may be enclosed by the first oil pressurized bore 220. A portion of the boundary of the first oil pressurized bore 220 may be defined by walls 228 of the cylinder head 210. Another portion of the boundary of the first oil pressurized bore 220 is defined by the retainer seal 212. The retainer seal 212 move axially within the first oil pressurized bore 220. In this way, the size of the first oil pressurized bore 220 may be altered. Therefore, in one example the retainer seal 212 is fixedly coupled to the valve stem 204 and may be configured to actuate the valve spring. Therefore, movement of the retainer seal 212 may also alter the force exerted by the valve spring 206 on the valve stem 204.

The first oil pressurized bore 220 includes a first port 230 and a second port 232. The first and second ports open into a chamber of the bore 220. Additionally, the first port 230 is in fluidic communication with the control valve assembly 300 shown in FIG. 3. On the other hand, the second port 232 is in fluidic communication with a second control valve assembly 250, corresponding to another cylinder. The second control valve assembly 250 may have similar components to the first control valve assembly 300 shown in FIG. 3. However, in other examples the second control valve assembly may have different components than the first control valve assembly. Furthermore, the second control valve assembly 250 may be associated with the cylinder 62, shown in FIG. 1.

The first port 230 is in fluidic communication with the control valve assembly 300, shown in FIG. 3. Arrow 234 denotes the fluidic communication between the first port 230 and the control valve assembly 300. The second port 232 may be in fluidic communication with a second control valve assembly 250 associated with the cylinder 62, shown in FIG. 1. The fluidic communication between the second port 232 and the second control valve assembly 250 is denoted via arrow 236. Furthermore, the second control valve assembly 250 is generically depicted via a box. However in one example, the second control valve assembly 250 may have similar components to the first control valve assembly 300, shown in FIG. 3. It will be appreciated that the oil flow entering and/or exiting first and second ports may be adjusted by the control valve assemblies to alter the oil pressure in the first oil pressurized bore 220. The pressure adjustment in the first oil pressurized bore is discussed in greater detail herein. It will be appreciated that one or more oil lines, conduits, etc., may be used to provide fluidic communication between the aforementioned components.

The cylinder valve system 200 further includes a second oil pressurized bore 238. The lash adjuster 221 is positioned in the second oil pressurized bore 238. Thus, the lash adjuster 221 is enclosed by the second oil pressurized bore 238. As previously discussed, the lash adjuster 221 may be configured to vary the position of the rocker arm 222. In some examples, the motion of the lash adjuster as a result of the applied hydraulic force is in an opposite direction of the cam profile. The second oil pressurized bore 238 includes a first port 240 and a second port 242. The first port 240 may be in fluidic communication with a main oil gallery 260, generically denoted via a box, in the engine 50, shown in FIG. 1. The main oil gallery 260 may supply oil to or receive oil from various components in the engine. The fluidic communication between the first port 240 and the main oil gallery 260 is denoted via an arrow 244. The main oil gallery may be in fluidic communication with an oil reservoir (e.g., an oil pan) in the engine 50, shown in FIG. 1. The second port 242 may be in fluidic communication with the control valve assembly 300, denoted via arrow 246.

A volume of the second oil pressurized bore 238 is less than a volume of the first oil pressurized bore 220, in the depicted example. However, in other examples the volumes of the bores may be equal or the volume of the first oil pressurized bore 220 may be less than the volume of the second oil pressurized bore 238. Additionally, the first oil pressurized bore 220 may be referred to as a primary bore and the second oil pressurized bore 238 may be referred to as a secondary bore.

FIG. 3 shows a control valve assembly 300 corresponding the cylinder valve system 200 shown in FIG. 2. As shown, the control valve assembly 300 includes a first control valve 302 and a second control valve 304. The control valve assembly 300 also includes a first port 306 in fluidic communication with a common communication oil passage 350, denoted via arrow 307. The common communication oil passage 350 may be included in the engine 50, shown in FIG. 1. The common communication oil passage 350 may be in fluidic communication with the control valve assemblies associated with each of the cylinders (60, 62, 64, and 66) shown in FIG. 1.

The control valve assembly 300 includes a second port 308 in fluidic communication with the first oil pressurized bore 220, shown in FIG. 2, denoted via arrow 310. The control valve assembly 300 further includes a thirst port 312 in fluidic communication with the first oil pressurized bore 420, shown in FIG. 4, denoted via arrow 314. Additionally, the control valve assembly 300 includes a fourth port 316 in fluidic communication with the second oil pressurized bore 238, shown in FIG. 2, denoted via arrow 318.

The controller 110, shown in FIG. 1, may be in electronic communication with the first control valve 302 and the second control valve 304. The first and/or second control valves may be solenoid valves, in one example.

Each of the first control valve 302 and the second control valve 304 may be adjusted in 2 positions, an "up" position and a "down" position. In the configuration shown in FIG. 3 each of the first and second control valves (302 and 304) are in an "up" position. The dashed lines 320 indicate the position of the control valves (302 and 304) in a "down" position. The controller 110 may be configured to independently actuate the control valves in an "up" position and a down" position. Thus, the control valve may be adjusted between two configurations. However, control valves having additional controlled positions have been contemplated. Adjustment of the control valves between an "up" and "down" position enables independent adjustment of a valve lift magnitude as well as valve lift duration.

For example, during some engine operating conditions is may be desirable to provide a decreased (e.g., minimum) valve lift and valve actuation duration (e.g., opening/closing duration). In such an example, the first control valve 302 may be in a "down" position and the second control valve 304 may be in an "up" position. It will be appreciated that additional control valve assemblies in the engine may have the same configuration, such as control valve assembly 500, shown in FIG. 5 discussed in greater detail herein. Therefore, during valve operation the axial motion of the valve causes oil to be transferred between primary oil pressurized bores in cylinder valve systems associated with different cylinders via the common communication oil passage 350. Therefore in such an example, the valve system does not increase valve lift or valve opening/closing duration.

Additionally, during some engine operating conditions it may be desirable to provide increased valve lift without adjustment of the valve actuation duration. In such an example, the first control valve 302 is in an "up" position and the second control valve 304 is in an "up" position. Therefore, during valve operation oil is transferred from the first oil pressurized bore 220 to the second oil pressurized bore 238. The amount of oil transferred may be proportional to the ratio in diameters between the first and second bores. Transferring oil to the second oil pressurized bore 238 increases the lift of the cylinder valve 202 by moving the lash adjuster 220 axially out of the bore, thereby moving the pivot point of the cam follower 226 in the opposite direction of cam lift. Thus, the cam follower 226 moves in the direction of valve opening and the lash adjuster 221 move in the opposite direction of valve opening according the profile of the cam 224. It will be appreciated that in the control valve configuration described above the first and second oil pressurized bores (220 and 238) are both in fluidic communication with an oil pressurized bore 420 associated with the third cylinder (i.e., cylinder 64, shown in FIG. 1). However, there is no volume change in the bore 420 until after the maximum lift point of the cylinder valve 202. Therefore, the fluidic communication between the bore 420 and the bores (220 and 238) does not affect oil pressure in the bores during valve opening/closing. The second control valve 304 may be moved into a "down" position when a desired valve lift is achieved or after a maximum valve lift point of the cam 224 which allows valve closure is achieved. However, to provide increased valve closing duration, the second control valve 304 may be held in an "up" position for a long duration after the maximum valve lift point. When the second control valve 304 is held open for a longer duration the oil pressurized bore 420, shown in FIG. 4, may flow oil to the second oil pressurized bore 238. As a result, the cylinder valve 202 is held closed for a longer closing duration.

Further during some engine operating condition, it may be desirable to provide increased valve closing duration without increasing valve lift. In such an example, the first control valve 302 is held in a "down" position and the second control valve 304 is held in an "up" position. As a result, oil is transferred from the second oil pressurized bore 238 to the oil pressurized bore 420, shown in FIG. 4, closing the valve 202. When a desired valve closing duration is achieved the second control valve 304 is moved into a "down" configuration.

Additionally, it may be desirable to deactivate the cylinder valve 202 during some engine operating conditions. The first control valve 302 is held in a "down" position and timed such that hydraulic motion in a primary bore from an active cylinder valve is transferred to the primary bore 220 via the common communication oil passage 350. As a result, the cylinder valve 202 is held closed. Furthermore, the second control valve 304 is held in the "up" position. Consequently, the lash adjuster 221 in the second oil pressurized bore 238 to move in a direction opposing cam actuation. In some examples, for cylinder deactivation cam motion is absorbed by the lash adjuster. Therefore, the lash adjuster and the bore in which it is positioned may be sized to allow this absorption. Additionally, the size of the outlet of the bore may be sized to allow "blow off" of the resulting hydraulic pressure. As such, cylinder deactivation may be engine configuration dependent based on firing order and ability to allow the aforementioned characteristics for the deactivation functionality. It will be appreciated that the cams in the active cylinder valve may be positioned 180 degrees relative to the deactivated cylinder valve 202.

In some examples, a variable cam timing sprocket may be used to advance or retard the cam 224 to provide an earlier valve opening and a later valve closing of the valve 202.

It will be appreciated that the control sub-system 100, shown in FIG. 1, may be configured to deactivate the cylinder valve 202 based on engine operating conditions through adjustment of the control valve assembly 300 via the controller 110, shown in FIG. 1. Further, the control sub-system 100, shown in FIG. 1, may also be configured to adjust a valve lift magnitude based on engine operating conditions through adjustment of the control valve assembly 300 via the controller 110, shown in FIG. 1. Further still the control sub-system 100, shown in FIG. 1, may be configured to adjust a valve opening or closing duration based on engine operating conditions through adjustment of the control valve assembly 300 via the controller 110, shown in FIG. 1.

Figure 4:
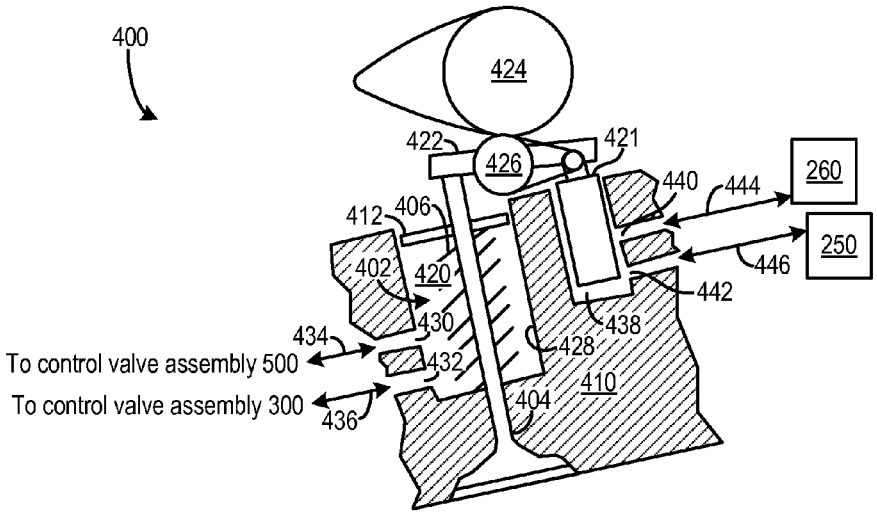
FIG. 4 shows an illustration of another example cylinder valve system which may be included in the engine shown in FIG. 1.
Figure 5:
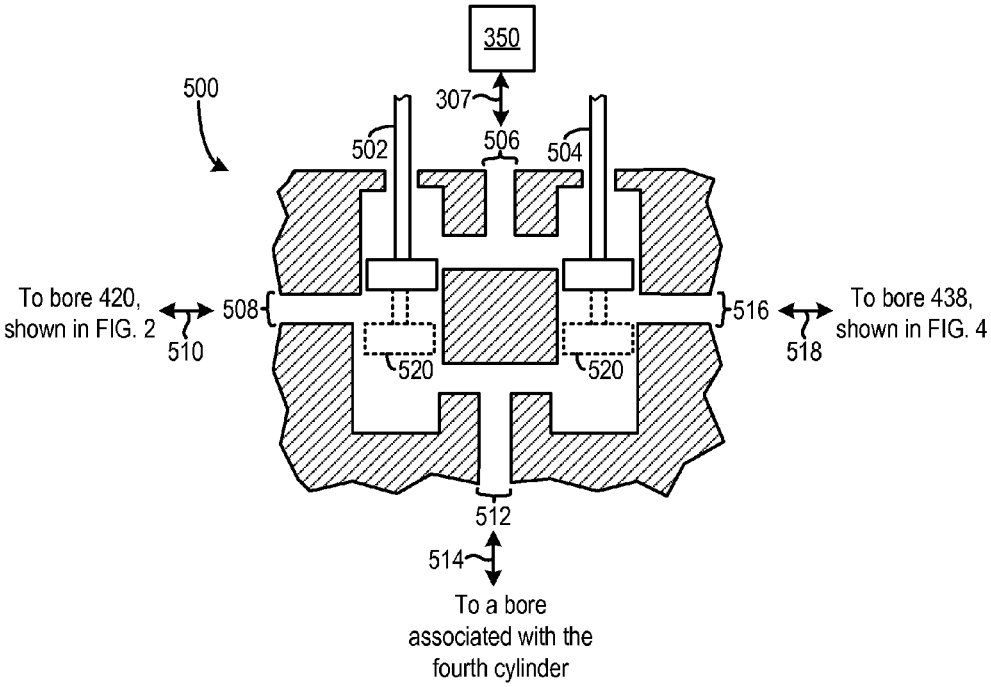
FIG. 5 shows an illustration of an example control valve assembly corresponding to the cylinder valve system shown in FIG. 4.

FIG. 4 shows an illustration of an example cylinder valve system 400 and FIG. 5 shows a third control valve assembly 500 corresponding to the cylinder valve system 400 shown in FIG. 4. Thus, the third control valve assembly 500 shown in FIG. 3 may be included in the cylinder valve system 400 shown in FIG. 4. It will be appreciated that in some examples, the cylinder valve systems (200 and 400) may be incorporated into a single cylinder valve system. The cylinder valve system 400 may be associated with the cylinder 64 (i.e., third cylinder) shown in FIG. 1. It will be appreciated that the cylinder valve system 400 may include the intake valve 86 or the exhaust valve 88 shown in FIG. 1. The cylinder valve system 400 includes a cylinder valve 402. The cylinder valve 402 may be an intake valve or an exhaust valve.

The cylinder valve system 400 shown in FIG. 4 includes similar components to the cylinder valve system 200 shown in FIG. 2. It will be appreciated that in one example the cylinder valve systems (200 and 400) may be substantially similar in componentry. However, in other examples, the cylinder valve systems may vary in componentry.

The cylinder valve 402 includes a valve stem 404 and a valve spring 406. One end of the valve spring 406 may be in contact with the cylinder head 410. Another end of the valve spring 406 may in contact with a retainer seal 412. The cylinder valve 402 may seat and seal on a port (e.g., intake port or exhaust port) the cylinder head 410. Thus, the cylinder valve 402 may be an intake valve or an exhaust valve.

The retainer seal 412 provides a seal for a first oil pressurized bore 420. The valve stem 404 may extend through the retainer seal 412. The retainer seal 412 may also be in sealing contact with a wall of the cylinder head 410. The retainer seal 412 may include a flexible material such as rubber and/or a polymeric material.

The cylinder valve system 400 further includes a rocker arm 422. The rocker arm 422 is mechanically coupled to the valve stem 404 and is configured to initiate actuation of the cylinder valve 402.

The cylinder valve system 400 further includes a cam 424. The cam 424 is rotationally coupled to a crankshaft included in the engine 50, shown in FIG. 1. The cam 424 is configured to cyclically actuate the cylinder valve 402. The position of the cam 424 corresponds to a TDC piston position in the cylinder 64, shown in FIG. 1. A cam follower 426 is also included in the cylinder valve system 400. The cam follower 426 may have the same functionality of the cam follower 226, shown in FIG. 2.

A lash adjuster 421 is also coupled to the rocker arm 422 and the cam follower 426.

The cylinder valve system 400 further includes a first oil pressurized bore 420. The first oil pressurized bore 420 encloses at least a portion of the valve stem 404 and the entire valve spring 406. However, in other examples only a portion of the valve spring 406 may be enclosed within the first oil pressurized bore 420. A portion of the boundary of the first oil pressurized bore 420 may be defined by walls 428 of the cylinder head 410. Another portion of the boundary of the first oil pressurized bore 420 is defined by the retainer seal 412. The retainer seal 412 move axially within the first oil pressurized bore 420. In this way, the size of the first oil pressurized bore 420 may be altered. Therefore, in one example the retainer seal 412 is fixedly coupled to the valve stem 404 and may be configured to actuate the valve spring. Therefore, movement of the retainer seal 412 may also alter the force exerted by the valve spring 406 on the valve stem 404.

The first oil pressurized bore 420 includes a first port 430 and a second port 432. The first and second ports open into a chamber of the bore. Additionally, the first port 430 is in fluidic communication with the control valve assembly 500, shown in FIG. 5. On the other hand, the second port 432 is in fluidic communication with the control valve assembly 300, shown in FIG. 3.

The first port 430 is in fluidic communication with the control valve assembly 500, shown in FIG. 5. Arrow 434 denotes the fluidic communication between the first port 430 and the control valve assembly 500. The second port 432 may be in fluidic communication with the control valve assembly 300, associated with the cylinder 60, shown in FIG. 1. The fluidic communication between the second port 432 and the control valve assembly 300 is denoted via arrow 436. It will be appreciated that the oil flow entering and/or exiting first and second ports may be adjusted by the control valve assemblies to alter the oil pressure in the first oil pressurized bore 420. It will be appreciated that one or more oil lines, conduits, etc., may be used to provide fluidic communication between the aforementioned components.

The cylinder valve system 400 further includes a second oil pressurized bore 438. The lash adjuster 421 is positioned in the second oil pressurized bore 438. Thus, the lash adjuster 421 is enclosed by the second oil pressurized bore 438. As previously discussed the lash adjuster 421 may be configured to vary the position of the rocker arm 422.

The second oil pressurized bore 438 includes a first port 440 and a second port 442. The first port 440 may be in fluidic communication with the main oil gallery 260, denoted via arrows 444. The second port 442 may be in fluidic communication with the control valve assembly 250, denoted via arrow 446.

FIG. 5 shows the third control valve assembly 500 corresponding the cylinder valve system 400 shown in FIG. 4. As shown the third control valve assembly 500 include a first control valve 502 and a second control valve 504. The third control valve assembly 500 also includes a first port 506 in fluidic communication with a common communication oil passage 350 included in the engine 50 shown in FIG. 1, denoted via arrow 507.

The control valve assembly 500 includes a second port 508 in fluidic communication with the first oil pressurized bore 420, shown in FIG. 4, denoted via arrow 510. The control valve assembly 500 further includes a thirst port 512 in fluidic communication with a first oil pressurized bore associated with the cylinder 64, shown in FIG. 1, denoted via arrow 514. Additionally, the control valve assembly 500 includes a fourth port 516 in fluidic communication with the second oil pressurized bore 438, shown in FIG. 4, denoted via arrow 518.

The controller 110, shown in FIG. 1, may be in electronic communication with the first control valve 502 and the second control valve 504. The first and/or second control valves may be solenoid valves, in one example.

Each of the first control valve 502 and the second control valve 504 may be adjusted in 2 positions, an "up" position and a "down" position. In the configuration shown in FIG. 5 each of the first and second control valves (502 and 504) are in an up position. The dashed lines 520 indicate the position of the control valves in the down position. The controller 110 may be configured to independently actuate the valves in an "up" position and a down" position.

It will be appreciated that the valve configurations discussed above with regard to the control valve assembly 300 shown in FIG. 3 may also be applied to the third control valve assembly 500 shown in FIG. 5 to alter the valve lift magnitude and/or valve closing/opening duration of the cylinder valve 402 associated with the third cylinder (i.e., cylinder 64 shown in FIG. 1).

Figure 6:
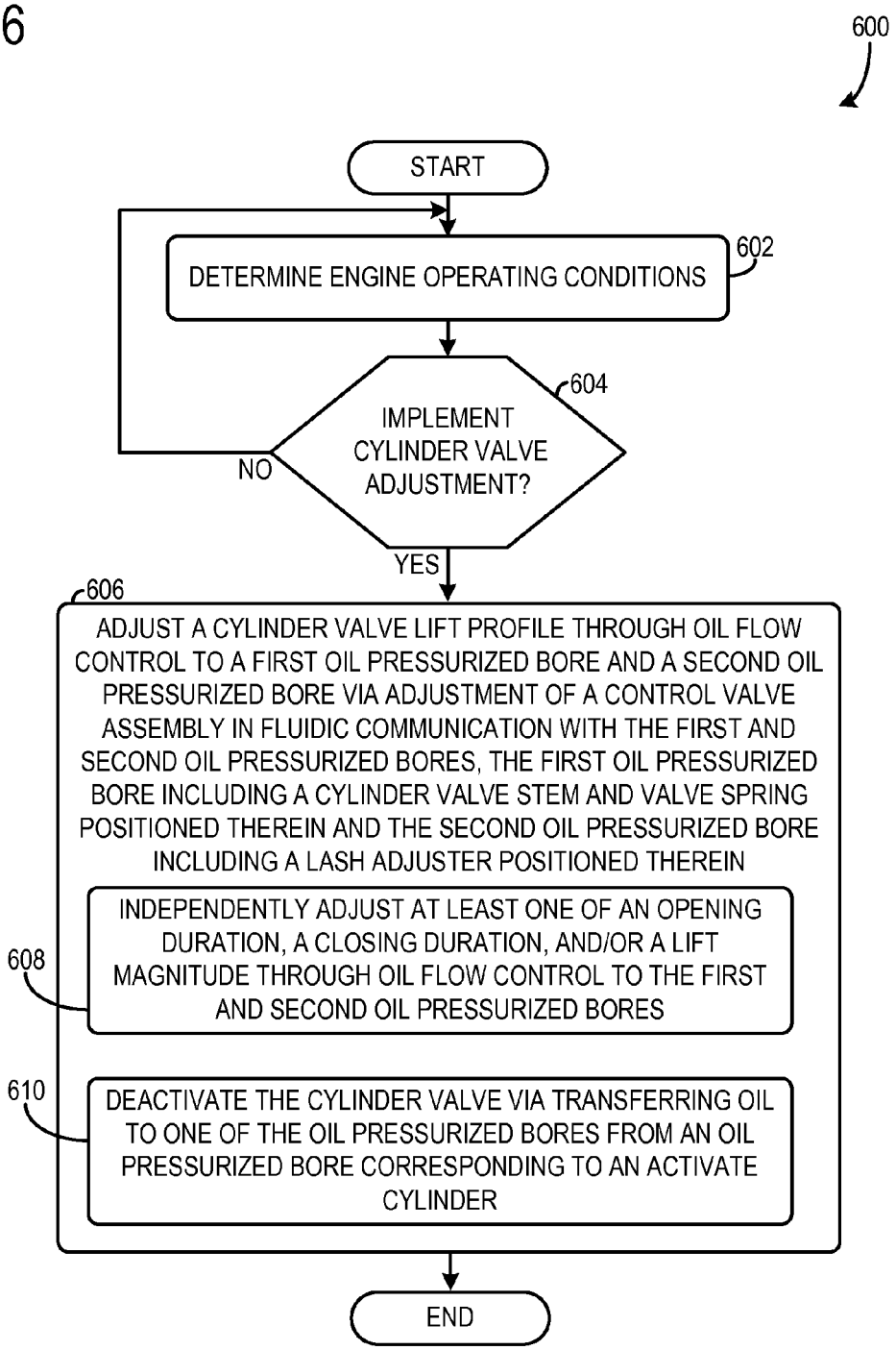
FIG. 6 shows a method for operation of a cylinder valve system in an engine.

FIG. 6 shows a method 600 for operation of a cylinder valve system in an engine. The method 600 may be implemented via the cylinder valve system and engine described above with regard to FIGS. 1-5 or may be implemented via another suitable cylinder valve system and engine.

At 602 the method includes determining engine operating conditions. The engine operating conditions include the engine temperature, engine output request, engine load, engine speed, intake manifold pressure, etc.

Next at 604 the method includes determining if cylinder valve adjustment should be implemented.

If it is determined that cylinder valve adjustment should not be implemented (NO at 604) the method returns to 602. However, if it is determined that the cylinder valve adjustment should be implemented (YES at 604) the method includes at 606 adjusting a cylinder valve lift profile through oil flow control to a first oil pressurized bore and a second oil pressurized bore via adjustment of a control valve assembly in fluidic communication with the first and second oil pressurized bores, the first oil pressurized bore including a cylinder valve stem and valve spring positioned therein and the second oil pressurized bore including a lash adjuster positioned therein. It will be appreciated that the volume of the first oil pressurized bore may not be equal to the volume of the second oil pressurized bore, in some examples.

Step 606 may include independently adjusting at least one of an opening duration, a closing duration, and/or a lift magnitude through the oil flow control to the first and second oil pressurized bores at 608 and deactivating the cylinder valve via transferring oil to one of the oil pressurized bores from an oil pressurized bore corresponding to an activate cylinder at 610.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described methods. The subject matter of the present disclosure includes all novel and non-obvious combinations and sub-combinations of the various systems and configurations, and other features, functions, and/or properties disclosed herein.

The invention claimed is:

1. An engine cylinder valve system comprising:

a first oil pressurized bore having a stem of a cylinder valve arranged therewithin and in fluidic communication with a control valve assembly, the assembly comprising first and second hydraulic valves and first, second, third, and fourth ports, and the first oil pressurized bore comprising first and second ports opening into a chamber thereof, the first port of the first oil pressurized bore in fluidic communication with the second port of the assembly;

a second oil pressurized bore corresponding to the cylinder valve and in fluidic communication with the assembly, the second oil pressurized bore comprising first and second ports opening into a chamber thereof, the second port of the second oil pressurized bore in fluidic communication with the fourth port of the assembly; and a controller configured to adjust a profile of the cylinder valve by axially adjusting each of the hydraulic valves between up and down positions.

2. The cylinder valve system of claim 1, further comprising a lash adjuster positioned in the second oil pressurized bore.

3. The cylinder valve system of claim 2, further comprising a valve spring of the cylinder valve positioned in the first oil pressurized bore, wherein the valve stem of the cylinder valve is mechanically coupled to the lash adjuster.

4. The cylinder valve system of claim 3, further comprising a flexible retainer seal sealing a portion of the first oil pressurized bore.

5. The cylinder valve system of claim 1, where the first port of the assembly is in fluidic communication with a common communication oil passage of the engine, the first hydraulic valve is in fluidic communication with the first port of the first oil pressurized bore via the second port of the assembly, and the second hydraulic valve is in fluidic communication with the second port of the second oil pressurized bore via the fourth port of the assembly.

6. The cylinder valve system of claim 5, where the first and second hydraulic valves are solenoid valves.

7. The cylinder valve system of claim 5, where the first oil pressurized bore is in fluidic communication with a third oil pressurized bore via the third port of the assembly and the first port of the first oil pressurized bore, the third oil pressurized bore corresponding to a second cylinder valve coupled to a second cylinder, the first cylinder valve coupled to a first cylinder.

8. The cylinder valve system of claim 7, where the second cylinder is combusted subsequent to the first cylinder.

9. The cylinder valve system of claim 1, further comprising a control sub-system deactivating the cylinder valve based on engine operating conditions through adjustment of the control valve assembly via the controller, the adjustment comprising the first hydraulic valve being held in the down position and the second hydraulic valve being held in the up position.

10. The cylinder valve system of claim 1, further comprising a control sub-system adjusting a lift magnitude of the cylinder valve based on engine operating conditions through independent adjustment of each of the first and second hydraulic valves of the control valve assembly between the up position and the down position via the controller.

11. The cylinder valve system of claim 1, further comprising a control sub-system adjusting an opening or closing duration of the cylinder valve based on engine operating conditions through independent adjustment of each of the first and second hydraulic valves of the control valve assembly between the up position and the down position via the controller.

12. The cylinder valve system of claim 1, wherein during operation of the control valve assembly, the axial adjustment of the hydraulic valves causes oil to be transferred between primary oil pressurized bores in cylinder valve systems associated with different cylinders via a common communication oil passage.

13. A cylinder valve system in an engine comprising:

a first oil pressurized bore corresponding to a cylinder valve and in fluidic communication with a control valve assembly, the control valve assembly comprising first and second hydraulic valves, the first oil pressurized bore comprising first and second ports opening into a chamber thereof;

a cylinder valve stem positioned in the first oil pressurized bore;

a second oil pressurized bore corresponding to the cylinder valve and in fluidic communication with the control valve assembly, the second oil pressurized bore comprising first and second ports opening into a chamber thereof;

a lash adjuster positioned in the second oil pressurized bore; and a controller configured to adjust a profile of the cylinder valve by independently axially adjusting each of the hydraulic valves between up and down positions.

14. The cylinder valve system of claim 13, wherein the control valve assembly comprises four ports including a first port in fluidic communication with a common oil passage, a second port in fluidic communication with the first port of the first oil pressurized bore, and a fourth port in fluidic communication with the second port of the second oil pressurized bore.

15. The cylinder valve system of claim 14, wherein a third port of the control valve assembly is in fluidic communication with an oil pressurized bore associated with a second cylinder valve coupled to another cylinder.

16. The cylinder valve system of claim 15, wherein the control valve assembly is a first control valve assembly, wherein the second port of the first oil pressurized bore is in fluidic communication with a second control valve assembly, wherein the cylinder valve is a cylinder valve of a first cylinder, wherein the cylinder to which the second cylinder valve is coupled is a third cylinder, wherein the second control valve assembly is coupled to a second cylinder, and wherein the first cylinder is fired first, the third cylinder is filed second, a fourth cylinder is fired third, and the second cylinder is fired fourth in a cylinder firing order.

17. The cylinder valve system of claim 13, where the cylinder valve is an intake valve.

18. The cylinder valve system of claim 13, where a volume of the first oil pressurized bore is not equivalent to a volume of the second oil pressurized bore.

19. A method for operation of a cylinder valve system in an engine, comprising:

adjusting a cylinder valve lift profile via oil flow control to a first oil pressurized bore and a second oil pressurized bore via independent axial adjustment of each of a first and a second hydraulic valve of a control valve assembly between up and down positions, the control valve assembly in fluidic communication with the first and second oil pressurized bores, the first oil pressurized bore including a cylinder valve stem and valve spring positioned therein, and the second oil pressurized bore including a lash adjuster positioned therein, where adjusting the cylinder valve lift profile includes deactivating a cylinder valve by holding the first hydraulic valve in the down position to transfer oil from an active cylinder valve to the first oil pressurized bore via a common communication oil passage in fluidic communication with the assembly while holding the second hydraulic valve in the up position and not transferring oil from the active cylinder valve to the second oil pressurized bore.

20. The method of claim 19, where adjusting the cylinder valve lift profile further includes independently adjusting at least one of an opening duration, a closing duration, and a lift magnitude of the cylinder valve.

* * * * *